US007170380B2

(12) United States Patent
Fischer et al.

(10) Patent No.: US 7,170,380 B2
(45) Date of Patent: Jan. 30, 2007

(54) IGNITION COIL

(75) Inventors: Bernd Fischer, Sulzberg (DE); Markus Weimert, Immenstadt (DE); Konstantin Lindenthal, Blaichach (DE); Tim Skowronek, Missen-Wilhatis (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/055,437

(22) Filed: Feb. 9, 2005

(65) Prior Publication Data

US 2005/0184846 A1 Aug. 25, 2005

(30) Foreign Application Priority Data

Feb. 19, 2004 (DE) ..... 10 2004 008 013

(51) Int. Cl.
*H01F 27/02* (2006.01)

(52) U.S. Cl. ..... 336/90

(58) Field of Classification Search ..... 336/90
See application file for complete search history.

(56) References Cited

U.S. PATENT DOCUMENTS

| | | | | |
|---|---|---|---|---|
| 2,914,719 | A * | 11/1959 | Walton et al. | 363/126 |
| 4,602,308 | A * | 7/1986 | Montague | 361/91.5 |
| 6,559,747 | B2 * | 5/2003 | Shimoide et al. | 336/96 |
| 2005/0007224 | A1 * | 1/2005 | Muller et al. | 335/205 |

* cited by examiner

*Primary Examiner*—Elvin Enad
(74) *Attorney, Agent, or Firm*—Kenyon & Kenyon LLP

(57) ABSTRACT

An ignition coil for an internal combustion engine, including a magnetically active core, a first coil shell which is used as a support for a first coil winding made of an electrically conductive wire, and a second coil shell which is positioned so as to be concentric to the first coil shell and is used as a support for a second coil winding made of an electrically conductive wire. Situated between the first coil winding and the second coil winding is a shielding layer, which is made of an electrically conductive material and provided with a grounding contact.

2 Claims, 1 Drawing Sheet

IGNITION COIL

FIELD OF THE INVENTION

The present invention relates to an ignition coil for an internal combustion engine, in particular for an internal combustion engine of a motor vehicle.

BACKGROUND INFORMATION

An ignition coil is known to be in practical use and takes, for example, the form of a so called rod-type ignition coil of a spark-ignition engine of a motor vehicle.

An ignition coil represents an energy-transmitting, high-voltage source used in a spark-ignition engine for controlling at least one spark plug, whose electrodes are inserted into a combustion chamber of the internal combustion engine, and which is used for igniting a fuel mixture introduced into the combustion chamber, whereby a movement of an engine piston and, therefore, of an engine crankshaft is initiated.

A conventional type of ignition coil has two concentric windings, which have different numbers of turns per unit length and are magnetically coupled to each other. The magnetic coupling is strengthened by a magnetically active coil core.

The coil winding having the lower number of turns per unit length is referred to as the primary winding and is assigned to a primary circuit. The coil winding having the larger number of turns per unit length is referred to as a secondary winding and is assigned to a secondary circuit, which also includes the spark plug in question. The primary winding represents an excitation winding and is supplied with energy by an electrical system of the motor vehicle in question. It is controlled by a control unit of the internal combustion engine, using an electronic switch that can be designed as an output stage or igniter. In order to produce, at the secondary winding connected to the spark plug, a high voltage that generates a spark between the electrodes of the spark plug, a deliberate break is made in the primary circuit.

In rod-type ignition coils, the secondary winding is normally the inner winding, while the primary winding constitutes the outer winding. One end of the secondary winding is connected to a high-voltage terminal of the spark plug. The other end of the secondary winding is connected to ground.

Because of the spark formation between its electrodes, the spark plug represents a source of interference with regard to electromagnetic compatibility (EMC) and may therefore impair the performance of other components of the system formed by the motor-vehicle electrical system. The interference may spread via both line-conduction and radiation, the line-conducted portion normally predominating. Therefore, electrical interference signals, which are produced by the spark formation initiated at the spark plug, may be transmitted from the spark plug into the vehicle electrical system, via the ignition coil. These interference signals couple over both inductively and capacitively from the secondary circuit of the ignition coil into the primary circuit and, in this manner, they enter the vehicle electrical system. The capacitive coupling occurs due to so-called parasitic capacitances between the primary winding and the secondary winding of the ignition coil. In known methods heretofore, e.g. anti-interference capacitors or the like are used to eliminate interference.

An object of the present invention is to provide, for an internal combustion engine, an ignition coil that includes a simple means for eliminating interference from the motor vehicle electrical system.

SUMMARY OF THE INVENTION

The present invention's ignition coil for an internal combustion engine, having a shielding layer, which is made of an electrically conductive material, preferably a conductive plastic, is situated between the first coil winding and the second coil winding, and is provided with a grounding contact, has the advantage that efficient interference suppression is ensured and the use of other expensive interference-suppression components, such as an anti-interference capacitor, may be dispensed with.

Of course, the shielding layer made of an electrically conductive material may be implemented in conjunction with interference-suppression measures known to be used in the field, in order to reduce an interference level in comparison with ignition coils known to be in practical use.

In particular, when the shielding layer, which may easily be integrated into the ignition coil, is designed to have a smooth surface, the risk of a disruptive electrical discharge from the coil winding connected to the spark plug to the other coil winding is decreased, since the acting electric field is homogenized.

The ignition coil according to the present invention takes the form of, in particular, a rod-type ignition coil. In this case, the first coil winding normally constitutes the secondary winding, which is surrounded by the second coil shell that forms the primary coil shell. An encapsulating material may be introduced between the primary coil shell and the secondary winding. The primary coil shell is used as a support for the primary winding connected to a low-voltage source.

The electrically conductive coating is, for example, galvanically deposited on the second coil shell or sprayed onto it, and is preferably situated on the exterior of the second coil shell.

It is also conceivable for the coating to be applied on the inside of the second coil shell. However, this design has the disadvantage that the insulation distance between the first coil winding and the conductive coating is thereby sharply reduced in comparison with the distance between the first coil winding and the second coil winding, which increases the risk of a disruptive electrical discharge.

In an alternative specific embodiment of the ignition coil according to the present invention, the shielding layer may be formed by the second coil shell, which, in the case of a rod-type coil shell, normally constitutes the primary coil shell. In this case, the second coil shell is therefore made of an electrically conductive material, preferably of a conductive plastic, and electrically contacted (connected) to ground. Therefore, in addition to functioning as a support for the second coil winding, the second coil shell also has a shielding function. However, in this specific embodiment, it must be ensured that sufficient space is available for maintaining a minimum insulation distance between the two windings.

DETAILED DESCRIPTION

Figure 1:
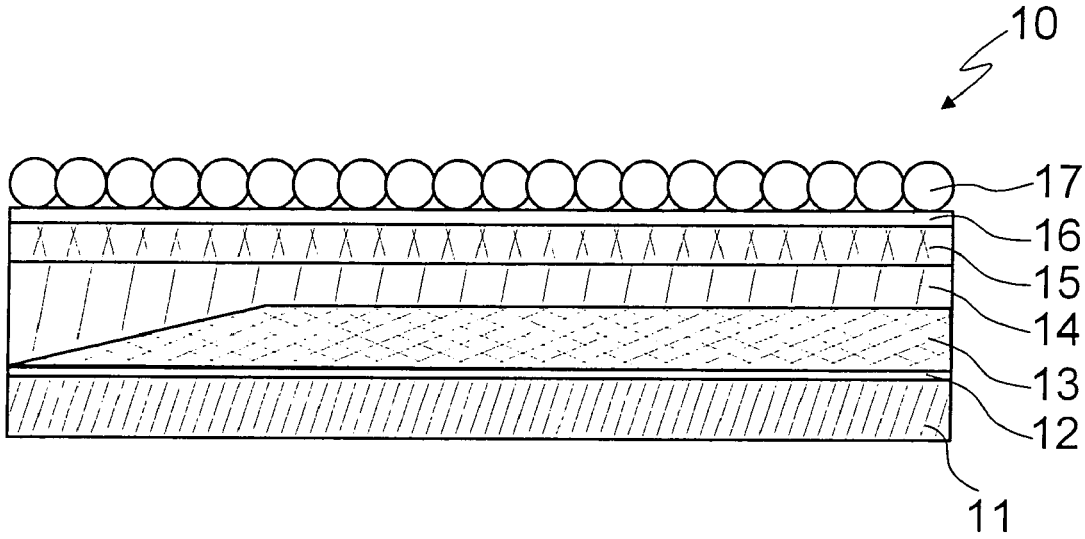
FIG. 1 shows a longitudinal cross-section of a detail of a first exemplary embodiment of an ignition coil according to the present invention.

FIG. 1 shows an ignition coil 10, which is part of an ignition system of a motor vehicle, spark-ignition engine not shown here in further detail.

Ignition coil 10 includes a coil core 11, which is made of iron or a core stack and is surrounded by a first coil shell 12 that forms the so-called secondary coil shell. Positioned on secondary coil shell 12 is a first coil winding 13, which forms the so-called secondary winding and is made out of insulated copper wire, and of which one end is connected to a high-voltage terminal of ignition coil 10, the high-voltage terminal being connectible, in turn, to a spark plug. The other end of secondary winding 13 is connected to ground.

Secondary winding 13 is surrounded by an electrically insulating, encapsulating material 14, which constitutes a supporting material for a second coil shell 15 that forms the so-called primary coil shell.

An electrically conductive coating 16 is applied to primary coil shell 15. Coating 16 is provided with a grounding contact. Coating 16 is surrounded by a second coil winding 17, which is likewise made of insulated copper wire, constitutes the so-called primary winding of coil 10, and is connected to a low-voltage source of an electrical system of the motor vehicle.

Electrically conductive coating 16 is used as a shield for electrical interference signals, which, without shielding layer 16, could be transmitted from secondary winding 13 to primary winding 17 and consequently to the electrical system of the motor vehicle.

Figure 2:
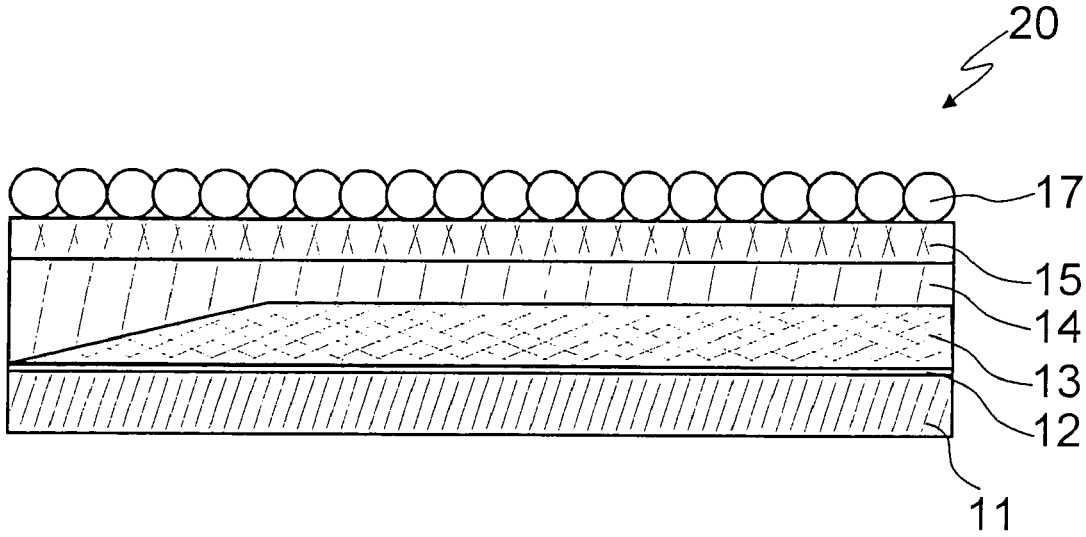
FIG. 2 shows a longitudinal cross-section of a detail of a second exemplary embodiment of an ignition coil according to the present invention.

FIG. 2 shows a second specific embodiment of an ignition coil 20, which again has a coil core 11, which is made out of a core stack and is surrounded by a first coil shell 12 that forms a secondary coil shell 12 and is used as a supporting material for a secondary winding 13.

Secondary winding 13 is surrounded, in turn, by an electrically insulating, encapsulating material 14, on which a primary coil shell 15 is situated that, in the present case, is made of an electrically conductive material and is used as a supporting material for a primary winding 17 connected to a low-voltage source of the motor-vehicle electrical system.

In the specific embodiment shown in FIG. 2, electrically conductive, primary coil shell 15, which is provided with a grounding contact, is used as a shield for interference signals, which may be generated by the spark plug connected to the secondary winding during an ignition procedure and could have a disadvantageous effect on the vehicle electrical system.

What is claimed is:

1. An ignition coil for an internal combustion engine, comprising:

a magnetically active core;

a first coil winding composed of an electrically conductive wire;

a first coil shell acting as a support for the first coil winding;

a second coil winding composed of an electrically conductive wire;

a second coil shell situated concentric to the first coil shell and acting as a support for the second coil winding; and a shielding layer being composed of an electrically conductive material, having a grounding contact, and being situated between the first coil winding and the second coil winding;

wherein the shielding layer is formed by a coating of the second coil shell.

2. An ignition coil for an internal combustion engine, comprising:

a magnetically active core;

a first coil winding composed of an electrically conductive wire;

a first coil shell acting as a support for the first coil winding;

a second coil winding composed of an electrically conductive wire;

a second coil shell situated concentric to the first coil shell and acting as a support for the second coil winding; and a shielding layer being composed of an electrically conductive material, having a grounding contact, and being situated between the first coil winding and the second coil winding;

wherein the shielding layer is formed by the second coil shell, and the second coil shell is composed of an electrically conductive plastic.

* * * * *